US011739553B2

(12) United States Patent
Nörenberg et al.

(10) Patent No.: US 11,739,553 B2
(45) Date of Patent: Aug. 29, 2023

(54) BUILDING, IN PARTICULAR A MULTISTORY BUILDING, AND USE OF A DAMPER IN SUCH A BUILDING

(71) Applicants: Ralf Nörenberg, Heidelberg (DE); Ingo Windeler, Vechta (DE)

(72) Inventors: Ralf Nörenberg, Heidelberg (DE); Ingo Windeler, Vechta (DE); Jan Wucherpfennig, Lemförde (DE); Stefan Schrantz, Lemförde (DE); Andreas Wuest, Ludwigshafen (DE); Tom Wilcock, New York, NY (US); Chris Ariyaratana, New York, NY (US)

( * ) Notice: Subject to any disclaimer, the term of this patent is extended or adjusted under 35 U.S.C. 154(b) by 113 days.

(21) Appl. No.: 17/424,586

(22) PCT Filed: Jan. 24, 2020

(86) PCT No.: PCT/EP2020/051835
§ 371 (c)(1),
(2) Date: Jul. 21, 2021

(87) PCT Pub. No.: WO2020/156963
PCT Pub. Date: Aug. 6, 2020

(65) Prior Publication Data

US 2022/0106805 A1 Apr. 7, 2022

Related U.S. Application Data

(60) Provisional application No. 62/796,366, filed on Jan. 24, 2019.

(51) Int. Cl.

| | |
|---|---|
| ***E04H 9/02*** | (2006.01) |
| ***E04B 2/90*** | (2006.01) |
| *E04B 1/19* | (2006.01) |

(52) U.S. Cl.
CPC ..... *E04H 9/0215* (2020.05); *E04B 2/90* (2013.01); *E04B 2001/1957* (2013.01)

(58) Field of Classification Search
None
See application file for complete search history.

(56) References Cited

U.S. PATENT DOCUMENTS 4,073,107 A * 2/1978 Rousseau ..... E04B 2/88 52/235
5,163,256 A * 11/1992 Fukumoto ..... E04H 9/02 52/573.1

(Continued)

FOREIGN PATENT DOCUMENTS

DE 000002425473 A1 12/1975
DE 3527224 A1 2/1987

(Continued)

OTHER PUBLICATIONS

International Search Report and Written Opinion for corresponding PCT Application No. PCT/EP2020/051835, dated Apr. 4, 2020.

(Continued)

*Primary Examiner* — Joshua K Ihezie
(74) *Attorney, Agent, or Firm* — Meagher Emanuel Laks Goldberg & Liao, LLP

(57) ABSTRACT

The invention relates to a building (1), in particular a multistory building,
which has a supporting structure (5), and a facade (3) which is operatively connected to the supporting structure and exposed to the wind, wherein the facade (3) has a plurality of facade elements (7), wherein the facade elements (7) are designed to move relative to the supporting structure (5) in reaction to a torsion of the supporting structure (5). It is proposed that at least some facade elements (7) are operatively connected to a number of dampers (13), wherein the (Continued)

Figure 1:
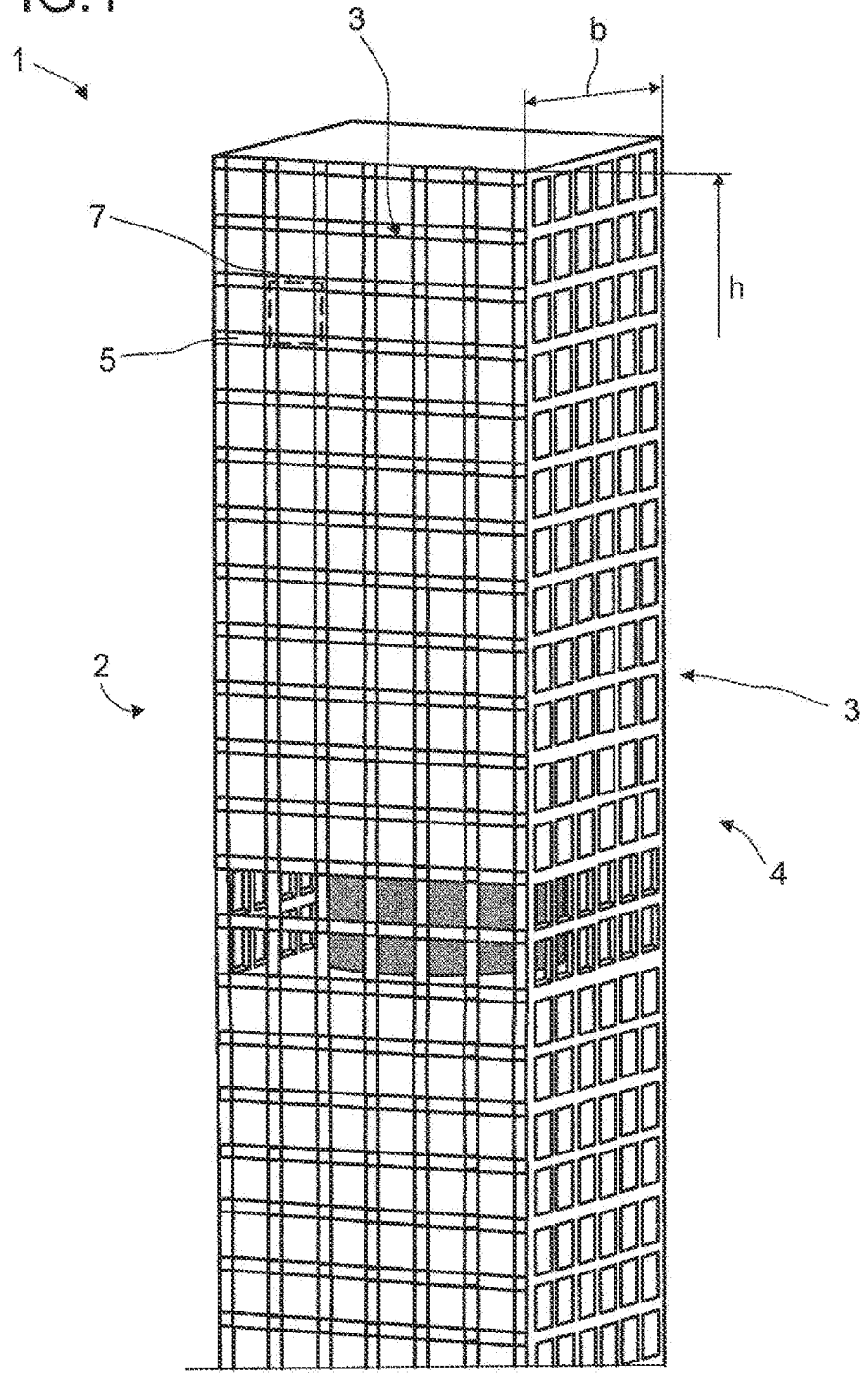

dampers (13) are designed to damp a movement of the facade elements (7) relative to the supporting structure (5).

19 Claims, 6 Drawing Sheets

(56) References Cited

U.S. PATENT DOCUMENTS

| | | | | |
|---|---|---|---|---|
| 8,051,623 | B2 * | 11/2011 | Loyd | E04F 13/0803 52/489.1 |
| 9,200,444 | B2 * | 12/2015 | Ra | E04B 2/96 |
| 2009/0133332 | A1 * | 5/2009 | Nielsen | E05F 15/53 49/195 |
| 2013/0051903 | A1 * | 2/2013 | Ra | E04B 2/90 403/205 |

FOREIGN PATENT DOCUMENTS

| | | | |
|---|---|---|---|
| DE | 202016007041 | U1 | 2/2017 |
| EP | 3192946 | A1 | 7/2017 |
| JP | H09279717 | A | 10/1997 |
| JP | 2001200600 | A | 7/2001 |
| JP | 2002061416 | A | 2/2002 |
| JP | 2002088957 | A | 3/2002 |
| JP | 2006161338 | A | 6/2006 |
| WO | 9007623 | A1 | 7/1990 |
| WO | 2006091308 | A2 | 8/2006 |

OTHER PUBLICATIONS

German Search Report for corresponding German Application No. 102018124400.2, dated Jul. 10, 2019.

* cited by examiner

BUILDING, IN PARTICULAR A MULTISTORY BUILDING, AND USE OF A DAMPER IN SUCH A BUILDING

The present invention relates to a building, in particular a multistory building, which has a supporting structure, and a facade which is operatively connected to the supporting structure and exposed to the wind, wherein the facade has a plurality of facade elements, wherein the facade elements are mounted in such a way that they move relative to the supporting structure in reaction to a torsion of the supporting structure.

The invention further relates to the use of dampers for damping torsion movements of a building, in particular of a multistory building.

In the past decades, a trend toward ever higher buildings has been set in town planning. This trend is encouraged by the fact that, in metropolitan regions, on account of an already existing building density, there is no new building space available or only a limited amount of available building space, but at the same time, ever more real estate space is required. This has led, and will also increasingly lead in the future, to slimline, high buildings, in particular multistory buildings, becoming established in the townscape. On account of the considerable facade area which the buildings offer up to the wind, it is the case that, with increasing height and increasing area size, there occur to ever greater extent torsion movements which are produced as a result of the wind and are taken up by the supporting structure. The supporting structure is operatively connected to the facade, for instance directly or indirectly, wherein the latter is the case in double-skin facades, for example.

For example, at a height of approximately 200 m in multistory buildings, even under usual wind conditions, there already occur torsion and pendulum movements in a range of 1 m or more in the horizontal direction. Pendulum movements can lead to the persons situated within the building feeling a sense of unease, similar to the phenomenon of seasickness. To prevent this, what is found to date in the prior art is the installation in the upper regions of the buildings of pendulum masses which are provided with dampers, also referred to as absorbers, in order to reduce the movement amplitude of the wind-induced oscillations.

The required inertial masses of such pendulums are considerable (in the range of several hundred tonnes), and with them also the required installation space. The installation space occupied by the pendulum is additionally no longer available for the primary use of the buildings, and therefore the theoretically possible utilizable volume of a building is restricted by the use of such pendulums. Particularly in expensive residential areas, where the above-described multistory buildings are used in particular, this therefore reveals the prior art to be disadvantageous for economical reasons. Moreover, this weight must additionally be taken up by the supporting structure, to be precise also in all the stories of the building that are situated below the pendulum.

A further possibility of reducing oscillations in the building consists in damping elements being integrated into the supporting structure obliquely, in a similar manner to a crane support structure. A disadvantage with this solution is that the entire building structure has to be changed. This solution is therefore found very seldomly.

The object on which the invention was based was to improve a building of the type described at the outset to the effect that the above-described disadvantages are overcome as far as possible. In particular, the object on which the invention was based was to improve the building described at the outset to the effect that the volume enclosed by the building can be better utilized, as far as possible without diminishing the oscillation-damping properties of the building. Furthermore, the object on which the invention was based was in particular to reduce the wind-induced torsions of the supporting structure of a building.

The invention achieves the underlying object in a building of the type described at the outset in that at least some facade elements are operatively connected to a number of dampers, wherein the dampers are designed to damp a movement of the facade elements relative to the supporting structure. In other words, the invention is targeted at damping the movement of the facade elements themselves and thus to make the facade an active structural element of the building that is involved in the damping. The invention is based on the finding that the facade elements present on a building facade necessarily perform relative movements with respect to the supporting structure, and preferably also with respect to one another, in order, in spite of a torsion movement of the supporting structure, to be able to remain on the supporting structure. Were the facade elements not able to move, they would be destroyed by a torsion of the supporting structure or be released from the supporting structure. The invention comes in here in that it utilizes the relative movement of the facade elements relative to the supporting structure and provides dampers at the points where relative movements occur, in particular relative movements of the facade elements or of their suspensions with respect to one another. In this way, energy can be directly dissipated through the movement of the facade elements, thus contributing to a reduction of the torsion movements of the supporting structure, in any case a reduction in the amplitude of these movements.

The invention is developed by virtue of the fact that in each case adjacent facade elements are designed to be displaced relative to one another in parallel in reaction to a torsion of the supporting structure. The relative movement of the facade elements with respect to one another is also damped according to the invention.

The facade elements are preferably arranged pivotably on the supporting structure, in particular suspended in receptacles provided on the supporting structure. What is to be understood here by a pivoting movement is a movement which has rotational and/or translational components.

The suspended arrangement of the facade elements results in the facade elements having a vertical movement component during a pivoting movement in the region of at least one of the receptacles. Also possible, however, are other types of mounting for the facade elements which result in a vertical movement of the facade elements in reaction to a movement of the building. In preferred embodiments, the dampers are therefore generally designed to damp the vertical movement component of the facade elements.

In a further preferred embodiment, the facade elements are arranged so as to be movable horizontally relative to the supporting structure. In this case, the dampers are preferably designed to display a damping action in the horizontal direction. In preferred alternatives, the dampers are designed to damp the horizontal relative movement of adjacent facade elements of a first story relative to facade elements of an adjacent second story, or in each case to damp a horizontal relative movement of the facade elements of a story relative to the supporting structure.

The invention is advantageously developed in that at least one damper is in each case operatively connected to two adjacent facade elements and is designed to damp the displacement movement of the facade elements with respect to one another. Alternatively or in addition, at least one damper is provided which is in each case operatively connected to a facade element on the one hand and to the supporting structure on the other hand and is designed to damp the relative movements of the facade elements relative to the supporting structure. The two above-described damping measures, that is to say the damping between adjacent facade elements on the one hand and the damping at the attachment points between facade and supporting structure on the other hand, can also be combined with one another in an application-specific manner.

Various damping mechanisms are conceivable according to the invention for implementing the damping. What is crucial in the first place is the idea of using the facade as a damped element for reducing oscillations. In preferred embodiments, the damper has one or more damper elements which are in each case in frictional or positive contact with one or more surfaces and are designed to produce damping by means of shear formation within the damping material during a displacement movement of the facade elements. Here, the one or more surfaces can be arranged on the facade elements themselves or on corresponding relatively movable components of the damper, and thus be directly or indirectly connected to the facade elements.

The intensity of the damping can preferably be defined via a prestressing of the damper elements, that is to say for example a partial compression transversely to the orientation of the surfaces. The size of the surface, which can be doubled for example by tandem formation, also enters into the damper parameters.

In addition to the principle of utilizing the material damping by shear, a frictional damping is also conceivable, wherein prestressing and surface also influence the damper values. A further influencing variable for the level of damping would be the specification of the surface structure of the friction surface or friction surfaces corresponding to the damper elements. However, lubricating medium or the like also has an influence.

The damping can occur by means of frictional and/or by means of material damping. In preferred embodiments, the damper has one or more damper elements which are designed to cause damping by means of material damping during a displacement movement of the facade elements with respect to one another. The utilization of the damping properties of a material has in particular advantages in terms of the wear behavior with respect to the frictional damping. With a view to the service life, such an embodiment is therefore particularly preferred. However, it is also optionally possible for a plurality of frictional designs to be combined with one another, in particular frictional and material damping.

With particular preference, the damper elements are arranged and attached in such a way that, during an incipient relative movement, they first produce damping by means of material damping, and produce damping by means of sliding friction only upon exceeding a predetermined extent of the relative movement. The latter comes into consideration in particular for exceptional load peaks. By combining these two operative mechanisms, a low-wear damping for "regular" relative movements, for instance as a result of average wind loads, is advantageously combined with a definable additional damping reserve for exceptionally high relative movements, for instance as a result of strong wind gusts or storm gusts. It is considered as a further advantage that even very high wind forces—in spite of a coupling of the facade elements—do not result in the facade elements or their suspensions being damaged.

When using material damping, the damper element is preferably partially or completely formed from an elastically deformable, in particular volume-compressible, material of which the material damping changes, in particular increases, with increasing prestressing, in particular precompression, and wherein the damper element is particularly preferably installed in an at least partially deformed, in particular partially compressed, state. The intensity of the damping, which is already produced at small relative movements of the facade elements with respect to one another, or of the supporting structure relative to the facade elements, is defined via the level of this precompression. As a result of the relative movement, the damper element is preferably exposed to a shear loading which is defined by a shear angle. The shear angle is for its part also defined by the distance between the relatively moved components transversely to the movement direction.

It is particularly sought within the scope of the invention to produce a high degree of damping already with small deflections of the facade elements in order to be able to dissipate a large amount of energy. At the same time, however, the uplift forces acting on the facade elements should as far as possible not be excessively large. What is meant by the so-called uplift forces are those forces or force components which act in the vertical direction of the facade elements and which can cause the facade elements to be lifted in their anchorings on the supporting structure.

According to a further aspect of the invention, the facade elements are preferably therefore arranged so as to be vertically movable relative to the supporting structure, and the dampers are designed to produce a damping action in the vertical direction.

This further aspect is both a preferred embodiment of the above-described first aspect and a concept of the invention on its own account.

In preferred alternatives, the dampers are designed to damp the relative movement of in each case a facade element or a plurality of facade elements jointly relative to the supporting structure, and/or to damp the movement of in each case a single facade element or a plurality of facade elements jointly relative to the supporting structure. Precisely that movement component which is responsible as uplift force for the undesired lifting of the facade elements in its anchorings is thereby damped.

In this aspect, the building adopts all the advantages of the building according to the first aspect. The advantages and preferred embodiments of the first aspect are simultaneously advantages of the second aspect, and vice versa.

The damper element preferably has two connection elements which are movable relative to one another for connection in each case to one of the two adjacent facade elements, or to a facade element on the one hand and the supporting structure on the other hand, and the damper element is operatively connected to the connection elements in such a way that the intensity of the deformation, in particular shear, increases with increasing relative movement of the connection elements with respect to one another.

This can be achieved for example in that one or more damper elements are enclosed between two connection elements, and are loaded in shear during a relative movement of the facade elements with respect to one another that also causes a relative movement of the connection elements.

In preferred embodiments, the damper element is partially or completely formed from an elastomer, preferably from rubber, MCU or the like. With further preference, the damper element is partially or completely formed from an elastomer on the basis of cellular, in particular microcellular or mixed-cell, polyurethane elastomers and/or on the basis of thermoplastic polyurethane.

In a further preferred embodiment, the adjacent facade elements each have a single-layer or multilayer viewing and/or covering element and a frame, wherein the frame is connected on at least one of its lateral surfaces to a damper and is designed to take up forces, in particular shear forces, which occur as a result of the damping and which act on the frame, and borders the window element in such a way that a force flow between part of the taken-up forces occurs through the window element. The bordering of the windows, in particular a peripheral bordering, in the frame for force introduction has the effect that the forces introduced during the pivoting movement of the facade elements, and consequently their relative movement, which runs via the damper, no longer have to flow exclusively via the frame of the facade element, but can be additionally channeled via the surface of the viewing and/or covering element, that is to say for example the glass surface of a viewing element. This is also referred to as "structural glazing" and leads to a stiffening of the frame, with the result that the latter remains more dimensionally stable. The forces are thus distributed over a larger area, thereby distributing the loading on the facade element overall more homogenously. The frame can be constructed with lower stiffness specifications, thus potentially making it possible to reduce the weight of the facade element. Furthermore, the window bordering consisting of an elastically deformable material, in particular with a predetermined material damping, also allows further damping to be introduced at the point between frame and window element.

In further preferred embodiments in which the adjacent facade elements in each case have a single-layer or multilayer viewing and/or covering element and a frame, the window element is preferably bordered in the frame by means of an elastically deformable, in particular volume-compressible, material, which is preferably designed to produce damping by means of material damping in reaction to a compression. Elastically deformable borders are above all also advantageous in the use of multilayer window elements, that is to say multiple glazing units. There is the possibility, in principle, in such systems that a slight offset exists between the different window layers. However, these slight offset dimensions are compensated for by using a bordering material. In addition, the elastic bordering material allows an expansion compensation as a result of temperature differences. Upon strong heating, the window element expands according to expectation differently than the frame bordering it, and this is also taken up by the elastically deformable bordering material. The bordering material therefore connects frame and glass, with the result that forces are also channeled via the window, and the facade element overall rather remains rectangular. Mention is also made of "blocking" in this context. Preferably, the "blocking" or an adhesive bonding of the panes to the frame should occur as rigidly as possible to ensure that even small building movements stiffen the frame to such an extent that a damper which is fastened to the frame and which, as it were, is connected in series experiences relative movements at all and can damp. Alternatively, all damping occurs in the glass-frame assembly. Instead of the damper, the frames could then be directly attached to one another or to the supporting structure.

In simple embodiments, the elastically deformable material for bordering the viewing and/or covering element can be a silicone material, for example. In other preferred embodiments, the elastically deformable material is preferably partially or completely formed from an elastomer (for example rubber, MCU or the like), in particular on the basis of microcellular or mixed-cell polyurethane elastomers and/or on the basis of thermoplastic polyurethane. With further preference, the material consists partially or completely of an elastically deformable adhesive. The advantageous properties of such materials are also advantageously noticeable in the bordering material of the window element.

In a further preferred embodiment, the damper has a plurality of damper elements which are designed as lamellae, are oriented substantially parallel to one another and are arranged in a sandwich-like manner between a number of first and second profile rails, wherein the first profile rails are connected to a first connection element of the damper, and the second profile rails are connected to a second connection element of the damper, wherein the two connection elements are movable relative to one another. The relative movability of the two connection elements makes it possible to compensate for tolerances during mounting, during the production of the facade or the production of the damper, and temperature expansions. In preferred embodiments, particularly those connection elements are meant which have already been mentioned further above in relation to further preferred embodiments, wherein the embodiment of the lamella-type damper element is also independent of the further features of the above-described embodiments and is to be considered as disclosed. As a result of the lamella-like design of the damper elements and sandwich-like arrangement between first and second profile rails, a very high number of damper elements is accommodated in a very small cross-sectional area, and it is possible with a very small installation space requirement for a very high degree of damping to be produced via the relative movement of the connection elements. As an alternative to the attachment of the profile rails to the connection elements, it would also be conceivable to omit the connection elements and to attach the profile rails directly to the adjacent facade elements or the supporting structure and the facade elements.

With particular preference, the facade defines a facade plane, and the lamellae and profile rails are oriented parallel to the facade plane. This has the result that the two connection elements and, with them, the adjacent facade elements or the supporting structures of the facade elements can perform a relative movement with respect to one another not only in the vertical direction, along the longitudinal sides of the facade elements, but also to a certain extent in the transverse direction with respect to one another. Mounting tolerances and heat expansion effects can be compensated for in a simple manner by the arrangement of lamellae which are transversely flexible.

In so far as mention is made within the scope of the present invention to buildings or multistory buildings, what is preferably particularly to be understood by this is that the building has a height of 50 m or more, further preferably a height of 100 m or more, particularly preferably a height of 150 m or more. The invention exhibits its advantages fundamentally in buildings starting from a certain height. To a particular extent, the invention exhibits its advantages in slimline high buildings, and in particular all the more the higher the building is in comparison to its base area. The base area can be expressed for example through the widths of the building sides. Slimline buildings are understood to be buildings whose height in relation to a width of a narrowest of the building sides lies in a range of 6 to 1 or more.

The invention has been described above with reference to a building on the basis of a first and second aspect. In a further aspect, the invention relates to the use of dampers for damping torsion movements of a building, in particular of a multistory building. The invention achieves the object on which it is based, in a building of the type described at the outset which has a supporting structure and a facade which is operatively connected to the supporting structure and is exposed to the wind, wherein the facade has a plurality of facade elements, wherein the facade elements are arranged so as to be movable, in particular horizontally and/or vertically and/or pivotably, relative to the supporting structure, and wherein the facade elements are designed to move relative to the supporting structure in reaction to a torsion of the supporting structure, in that at least some facade elements are operatively connected to a number of dampers, wherein the dampers damp a movement of the facade elements relative to the supporting structure. The use according to the invention makes use of the same advantages and preferred embodiments of the above-described building, and therefore reference is made to the above statements to avoid repetitions. The preferred embodiments of the building according to the first and second aspect are simultaneously preferred embodiments of the use according to the further aspect.

Figure 2:
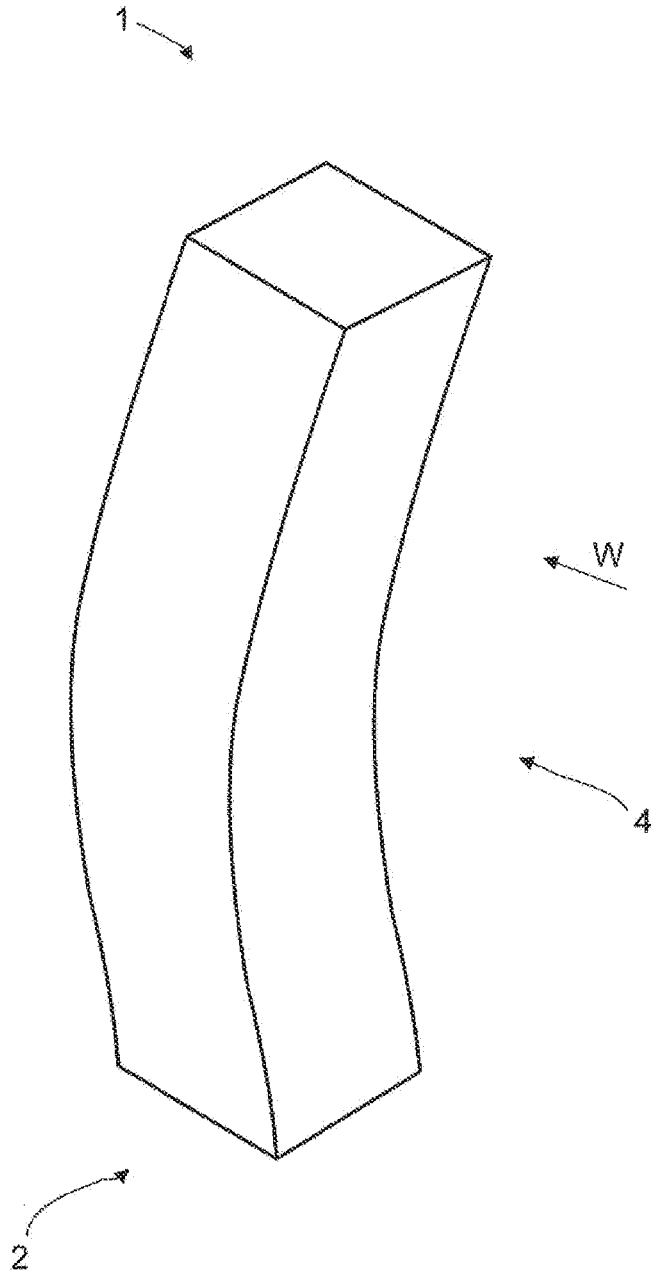
Figure 3:
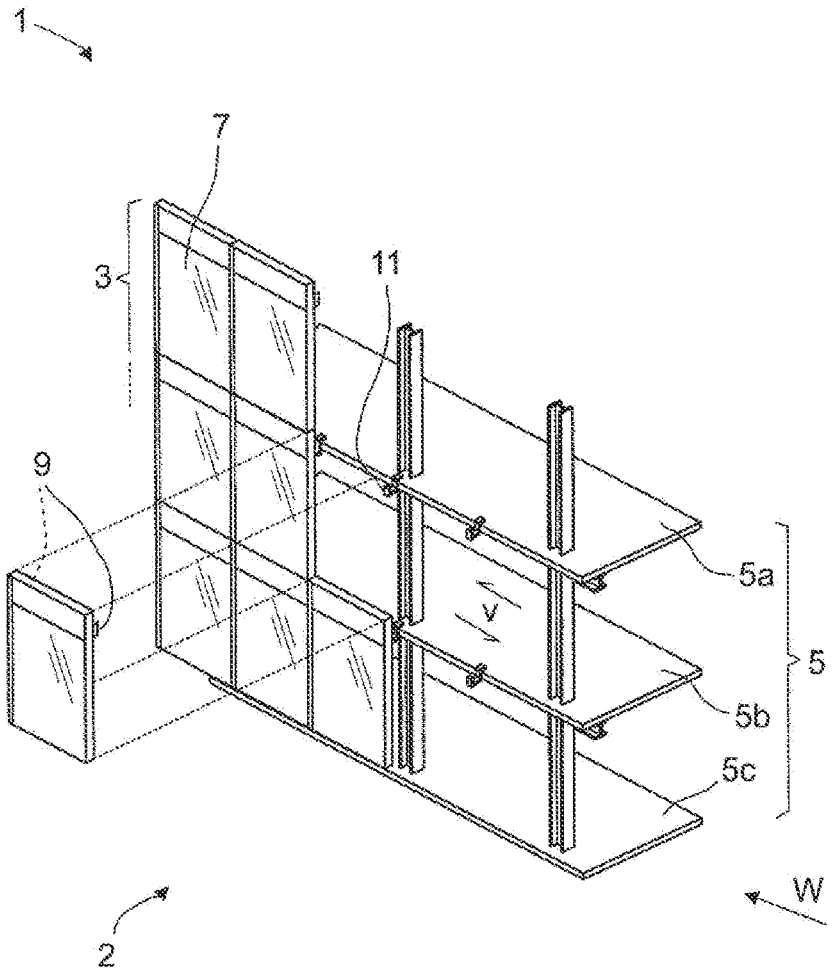
Figure 4:
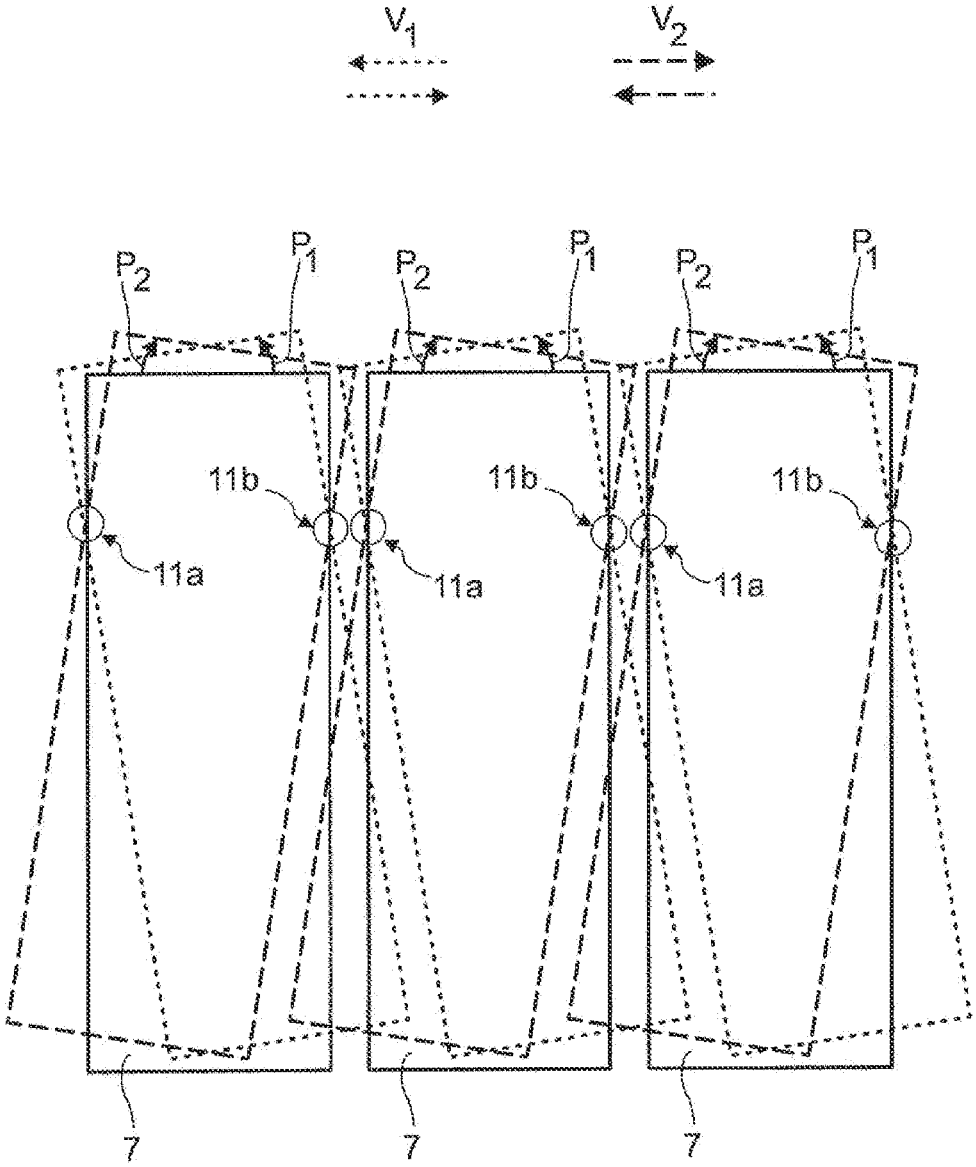

The invention will be described in more detail below with reference to the appended figures on the basis of a preferred exemplary embodiment, in which:

FIG. 1 shows a building according to a preferred exemplary embodiment in a schematic spatial illustration, FIG. 2 shows a schematic spatial illustration of a building under wind load, FIG. 3 shows a detail illustration of the building according to FIGS. 1 and 2, FIG. 4 shows a further detail illustration of part of a facade of the building of FIGS. 1 to 3, and FIGS. 5*a,b* show schematic detail illustrations of the facade of the building according to FIGS. 1 to 4, and FIG. 6 an alternative preferred arrangement of dampers for the building of FIGS. 1 to 4.

FIG. 1 shows first of all a building 1 which is designed as a multistory building and has a height h. The building 1 has a first building side 2 and a second building side 4, wherein each of the building sides 2, 4 has a facade 3. In the present exemplary embodiment, the second building side 4 is purely by way of example the narrower of the two building sides 2, 4, and has a width b. The height h of the building 1 is preferably at least six times the width b, particularly preferably ten or more times said width.

The building 1 has a supporting structure 5 to which the facade 3 is fastened. The facade 3 is composed of a plurality of facade elements 7.

If the building 1 is exposed to a wind load W (cf. FIG. 2) which impinges on the second building side 4 in the present graphic example according to FIG. 2, the building 1 is set in oscillation. The excitation caused by the wind load W ensures that the supporting structure 5 deflects by different amounts in the horizontal direction at different heights of the building. In the case of an exemplary excitation according to FIG. 2, this results in a strong torsion of the facade 3, particularly on the first building side 2.

As can be seen from FIG. 3, the facade elements 7 are in each case arranged adjacent to one another, next to one another and above one another, and thus form the facades 3. The facade elements 7 in each case have one or more coupling elements 9 which are designed to be connected to correspondingly formed receptacles 11 on sides of the supporting structure 5. The facade elements 7 are arranged so as to be movable relative to the supporting structure 5 in order that they are not damaged in the event of a torsion of the supporting structure 5 or, in the worst case, cannot be released from the supporting structure. In the present example according to FIG. 3, this is illustrated in that the supporting structure 5, which is designed in the exemplary embodiment as a substantially skeleton-shaped structure framework, has a plurality of vertically spaced-apart supporting structure planes 5*a, b, c*, wherein the facade elements 7 are in each case arranged on one of the supporting structure planes 5*a, b, c*. If a torsion V occurs as a result of the wind load W, the supporting structure elements 5*a, b, c* move relative to one another in the horizontal direction. In order that the facade elements 7 can accompany this movement, they are arranged pivotably on the receptacles 11, for example in that the coupling elements 9 are designed in the form of vertically oriented pins which can slide in the vertical direction in the receptacles 11, which are designed as corresponding openings or guides. Two exemplary types of this relative movement of the facade elements 7 are shown in FIG. 4.

FIG. 4 depicts three facade elements 7 adjacent to one another in a basic state. If a torsion is exerted in the direction of the arrows $V_1$, the facade elements 7 pivot in the direction of the arrows $P_1$ into a position which is angled relative to the basic state and optionally changed in terms of height. The relative movements and deformations shown in FIGS. 2 and 4 are illustrated in an exaggerated manner for the purpose of explanation.

If the facade elements 7, as shown in FIG. 4, are in each case connected at two ends to receptacles 11*a, b*, they would, during pivoting in the direction of the arrows $P_1$, perform, for example, a pivoting movement about the receptacle 11*a*, whereas they migrate slightly upward relative to the receptacle 11*b*. This is understood as an uplift movement, and the forces causing it are accordingly understood as uplift forces. However, the facade elements 7 also assume a parallel position with respect to one another in the torsioned position.

If a torsion $V_2$ occurs in the opposite direction, the adjacent facade elements 7 would be pivoted in the direction of the arrows $P_2$, in each case then around the receptacles 11*b*. It is to be observed in both deflection cases that in each case a parallel displacement occurs between the adjacent facade elements 7.

Figure 5A:
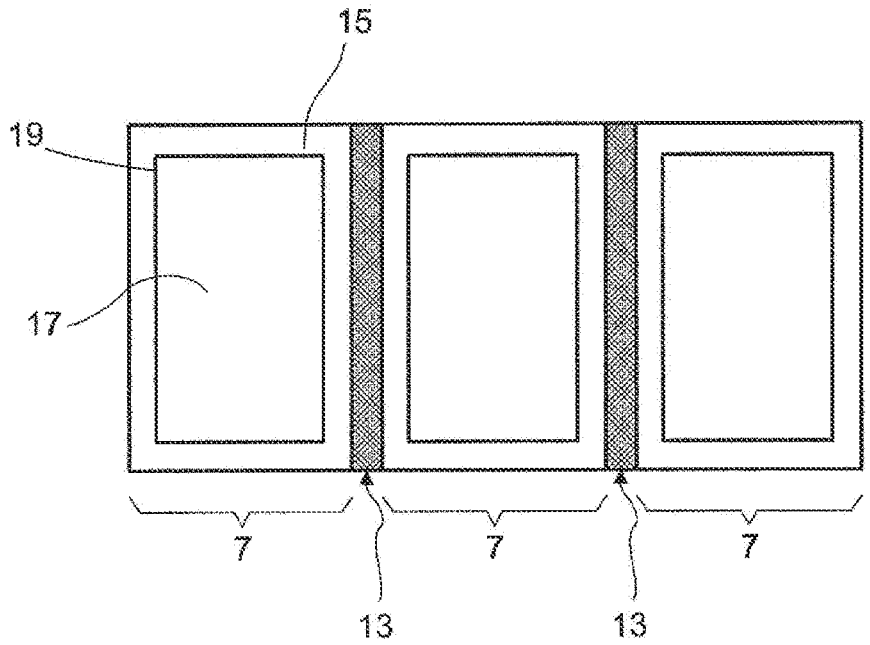
Figure 5B:
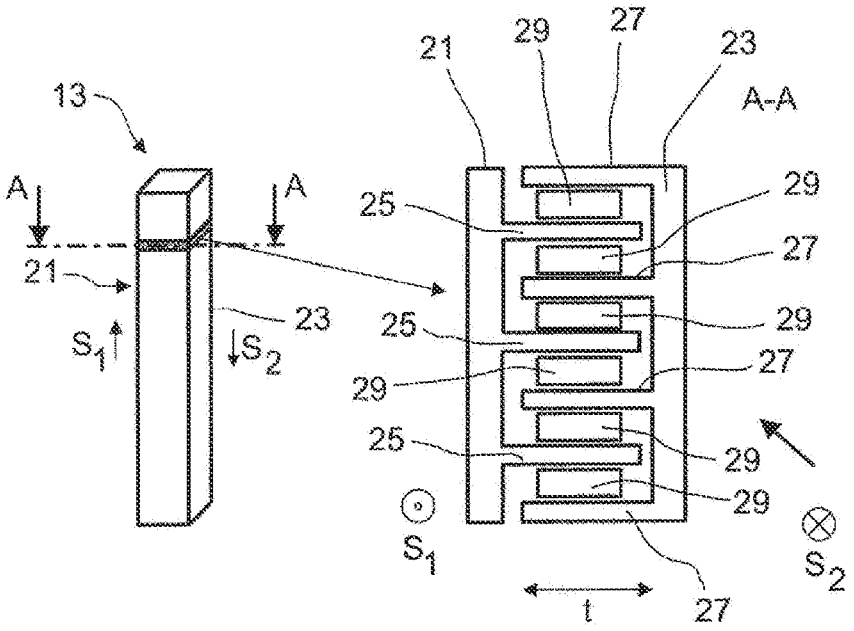

As shown from FIGS. 5*a, b*, the invention utilizes precisely this parallel displacement in that, according to a preferred exemplary embodiment, in each case a damper 13 is installed between adjacent facade walls 7. Upon a parallel displacement of the adjacent facade elements 7, the damper 13 produces damping of the movement and thus contributes to attenuating the oscillation amplitude. FIG. 5*b* shows, for a single damper 13, a sectional view in a plane transversely to the movement arrows $S_1$, $S_2$.

As an alternative to the exemplary embodiment shown in FIGS. 5*a, b*, it would also be possible to use the damper shown in FIG. 5*b* or an alternative damper, and also to arrange the damper shown in FIG. 5*b* or an alternative damper not between two adjacent facade elements 7, but between the supporting structure 5 on the one hand and in each case a facade element 7 on the other hand.

Alternatively or additionally to the vertical thrust movement, a horizontal compensation movement of the facade elements 7 in the direction t could also be used for damping, or even in addition.

The facade element 7 shown in FIGS. 5*a, b* has a frame 15 in which there is held a window element 17 which can be a single glazing unit or a multiple glazing unit. The window element 17 is preferably bordered in the frame 15 by means of an elastically deformable bordering material 19 and in this way "blocked". Upon torsions of the frame 15, the border 19 makes it possible for force to be transmitted into the window element 17 and out of the window element 17. If the material of the border 19 has damping properties, that is to say in particular a material damping, the border 19 also contributes to damping of the facade 3.

As can be seen in particular from FIG. 5*b*, the damper 13 preferably has a first connection element and a second connection element 23, by means of which elements the damper 13 can be mounted between adjacent facade elements, or alternatively on the one hand onto a facade element 7 and on the other hand onto the supporting structure 5. In the installed state, the connection elements 21, 23 perform the same parallel displacement with respect to one another as the facade elements 7, indicated in FIG. 5*b* by the arrows $S_1$ and $S_2$.

On the right in FIG. 5*b* there is shown a cross-sectional view from above through the damper 13. Illustrated here is an exemplary arrangement of damper elements 29 within the damper 13. The damper elements 29 are in each case arranged in a sandwich-like manner between two profile rails 25, 27, and particularly preferably prestressed, i.e. at least partially compressed. Here, a number of first profile rails 25 is fixedly connected to the first connection element 21, whereas a second number of second profile rails 27 is fixedly connected to the second connection element 23. The damper elements 29 are preferably fastened to one or both of the profile rails 25, 27 in a nonpositive, positive or integrally bonded manner. If such a connection is chosen, the material damping of the damper elements 29 is primarily utilized for damping. The damper elements 29 and the profile rails 25, 27 are preferably oriented parallel to the plane of the facade 3. As a result, the connection elements 21, 23 can to a certain degree execute compensation movements in the horizontal direction with respect to one another in the direction of the arrow t, that is to say substantially horizontally with respect to the building 1.

Figure 6:
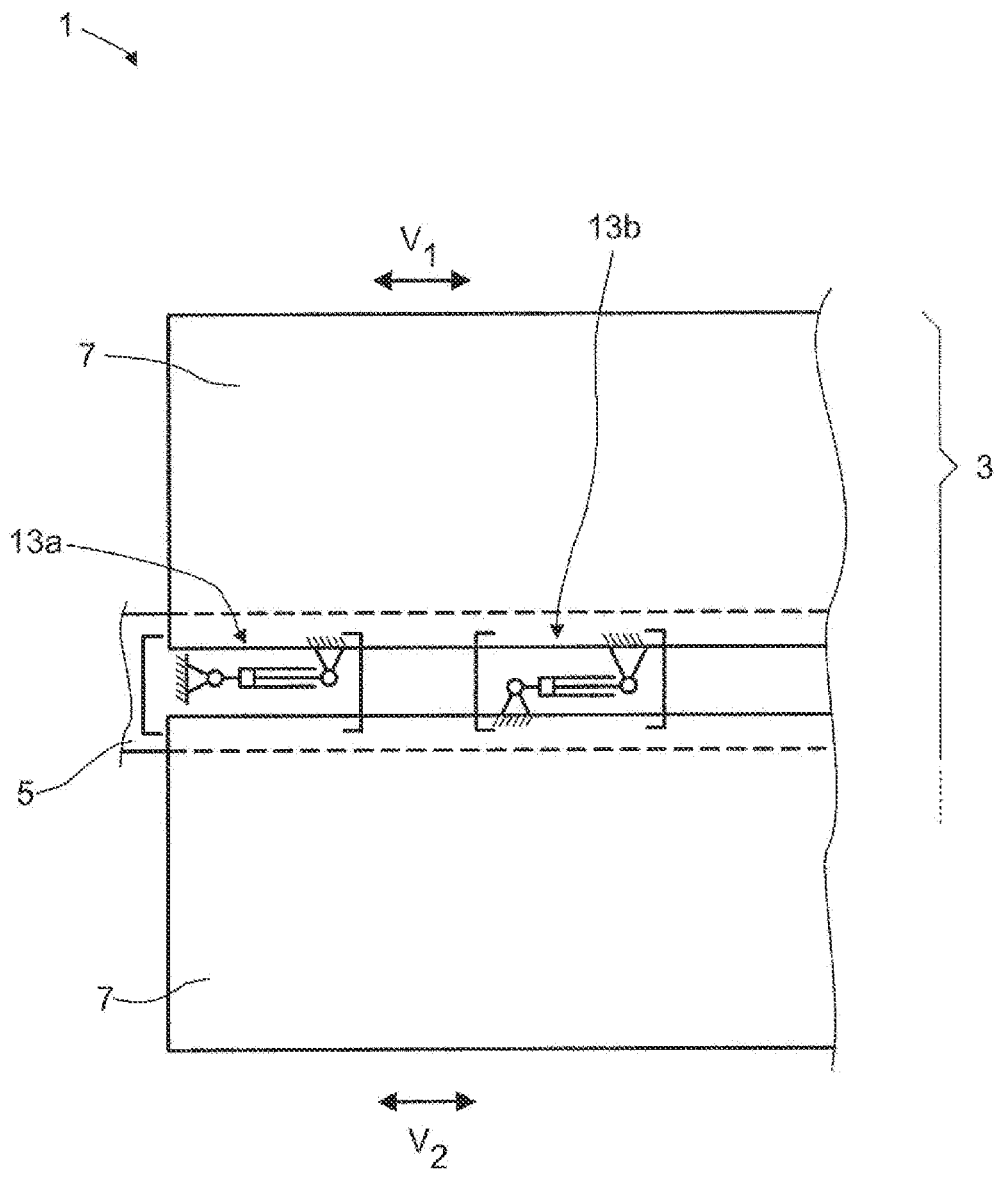

As an alternative to the vertical thrust movement, a horizontal compensation movement of the facade elements 7 could also be used for damping, or in addition, cf. FIG. 6.

Whereas the exemplary embodiment shown in FIGS. 5*a, b* showed the arrangement of a vertically acting damper 13 between two adjacent facade elements 7, the following FIG. 6 illustrates a further possible arrangement of two dampers 13*a*, 13*b* which, alternatively or additionally to the damping method according to FIGS. 5*a, b*, can advantageously be used on a facade 3 of a building 1. Alternatively or additionally to the damping of the relative movement of adjacent facade elements relative to the supporting structure 5 of the building 1 in the vertical direction, it is namely also possible for the relative movement of facade elements 7 relative to the supporting structure 5 to be damped in the horizontal direction. For this purpose, a damper 13*a* is preferably provided which is connected on the one hand to a facade element 7 and on the other hand to the supporting structure 5, and is designed to display a damping action in the horizontal direction. Alternatively or additionally, it is, of course, also possible to connect a damper 13*b* on the one hand to a facade element 7, and on the other hand not to the supporting structure, but to connect it likewise to a facade element 7, see damper 13*b*, wherein the damper in the same way displays a damping action in the horizontal direction.

The dampers 13*a, b* can also be used combinationally at suitable points of the building 1, and combinationally with damper elements which damp in the vertical direction, such as, for example, the dampers 13 according to FIGS. 5*a, b*.

The damper arrangement shown and the specifically shown example of a damper 13 or 13*a, b* in the figures are to be understood purely by way of example. The essence of the invention can also be implemented with other arrangements of the dampers relative to the facade elements 7 or the supporting structure 5, and also with other damping mechanisms, for example with fluid dampers.

This assists in the compensation of manufacturing tolerances of the facade 3 or supporting structure 5. When viewing the above explanations together, a concept has been proposed by the invention that for the first time allows the utilization of the torsion movement within the facade 3 to combat the wind-induced oscillations on a building 1. This makes it possible to resort to a lesser extent to oscillation members in the form of pendulum masses or in the best case even to dispense with them.

LIST OF REFERENCE SIGNS

1 Building
2 First building side
3 Facade
4 Second building side
5 Supporting structure
5*a,b,c* Supporting structure planes
7 Facade elements
9 Coupling elements
11*a,b* Receptacles
13 Damper
15 Frame
17 Window element
19 Border
21, 23 Connection element
25, 27 Profile rail
29 Damper elements
h Height of the building
b Width of the building
W Wind load
$V_{1,2}$ Torsion
$P_{1,2}$ Arrows
$S_{1,2}$ Arrows
t Arrow

The invention claimed is:

1. A building comprising:

a supporting structure, and a facade which is operatively connected to the supporting structure and exposed to the wind, wherein the facade has a plurality of facade elements, wherein the facade elements are mounted in such a way that they move relative to the supporting structure in reaction to a torsion of the supporting structure, wherein at least some facade elements are operatively connected to a number of dampers, wherein the dampers are designed to damp a movement of the facade elements relative to the supporting structure, and wherein the facade elements are arranged pivotably relative to the supporting structure and are suspended in receptacles provided on the supporting structure to allow the facade elements assuming a parallel position with respect to one another in reaction to the torsion of the supporting structure, wherein the parallel position is achieved by parallel displacement of the facade elements, and wherein the parallel displacement is utilized to damp the movement of the supporting structure.

2. The building according to claim 1, wherein in each case adjacent facade elements are designed to be displaced relative to one another in parallel in reaction to the torsion of the supporting structure.

3. The building according to claim 1, wherein the facade elements are arranged so as to be movable horizontally relative to the supporting structure, and the dampers are designed to display a damping action in the horizontal direction.

4. The building according to claim 1, wherein at least one damper is in each case operatively connected to two adjacent facade elements and is designed to damp the displacement of the facade elements with respect to one another.

5. The building according to claim 1, wherein at least one damper is in each case operatively connected to a facade element on the one hand and to the supporting structure on the other hand and is designed to damp the relative movement of the facade elements relative to the supporting structure.

6. The building according to claim 1, wherein the damper has one or more damper elements which are in each case in frictional contact with one or more friction surfaces and are designed to produce damping by means of sliding friction during a displacement movement of the facade elements with respect to one another.

7. The building according to claim 1, wherein the damper has one or more damper elements which are designed to produce damping by means of material damping during a displacement movement of the facade elements with respect to one another.

8. The building according to claim 7, wherein the damper element is partially or completely formed from an elastically deformable material of which the material damping increases with increasing prestressing, and wherein the damper element is installed in an at least partially deformed state.

9. The building according to claim 8, wherein the damper element has two connection elements which are movable relative to one another for connection in each case to one of the two adjacent facade elements, or to a facade element on the one hand and the supporting structure on the other hand, and the damper element is operatively connected to the connection elements in such a way that the intensity of the prestressing decreases with increasing relative movement of the connection elements with respect to one another.

10. The building according to claim 7, wherein the damper element is partially or completely formed from an elastomer on the basis of cellular or microcellular polyurethane elastomers.

11. The building according to claim 1, wherein adjacent facade elements in each case have a single-layer or multilayer window element and a frame, wherein the frame is connected on at least one of its lateral surfaces to a damper and is designed to take up forces, which occur as a result of the damping and which act on the frame, and borders the window element in such a way that a force flow of at least part of the taken-up forces occurs through the window element.

12. The building according to claim 1, wherein adjacent facade elements in each case have a single-layer or multilayer window element and a frame, wherein the window element is bordered in the frame by means of an elastically deformable material which is designed to produce damping by means of material damping in reaction to a compression.

13. The building according to claim 7, wherein the damper has a plurality of damper elements which are designed as lamellae, are oriented substantially parallel to one another and are arranged in a sandwich-like manner between a number of first and second profile rails, wherein the first profile rails are connected to a first connection element of the damper, and the second profile rails are connected to a second connection element of the damper, wherein the two connection elements are movable relative to one another.

14. The building according to claim 13, wherein the facade defines a facade plane, and the lamellae and profile rails are oriented parallel to the facade plane.

15. The building according to claim 1, wherein the building has a plurality of building sides and a height and a ratio of height to width of a narrowest of the building sides in a range of 6/1 or more.

16. A method of using dampers for damping torsion movements of a building, wherein the building has a supporting structure, and a facade which is operatively connected to the supporting structure and exposed to the wind, wherein the facade has a plurality of facade elements, wherein the facade elements are arranged movably relative to the supporting structure, and wherein the facade elements are designed to move relative to the supporting structure in reaction to a torsion of the supporting structure, wherein at least some facade elements are operatively connected to a number of dampers, wherein the dampers damp a movement of the facade elements relative to the supporting structure, the method comprising:

arranging the facade elements pivotably relative to the supporting structure;

suspending the facade elements in receptacles provided on the supporting structure to allow the facade elements assuming a parallel position with respect to one another in reaction to the torsion of the supporting structure, wherein the parallel position is achieved by parallel displacement of the facade elements, and wherein the parallel displacement is utilized to damp the movement of the supporting structure.

17. The building according to claim 7, wherein the damper element is partially or completely formed from a volume compressible material of which the material damping increases with increasing precompression and wherein the damper element is installed in an at least partially compressed state.

18. The building according to claim 7, wherein the damper element is partially or completely formed from an elastomer on the basis of thermoplastic polyurethane elastomers.

19. The building according to claim 7, wherein the damper element is partially or completely formed from an elastomer on the basis of mixed cell polyurethane elastomers.

* * * * *